US006374929B1

(12) United States Patent
Barbera

(10) Patent No.: US 6,374,929 B1
(45) Date of Patent: Apr. 23, 2002

(54) SUBTERRANEAN BORING MACHINE

(76) Inventor: James Barbera, 1635-37th St., NW., Canton, OH (US) 44709

( * ) Notice: Subject to any disclaimer, the term of this patent is extended or adjusted under 35 U.S.C. 154(b) by 0 days.

(21) Appl. No.: 09/461,127

(22) Filed: Dec. 14, 1999

(51) Int. Cl.[7] ..... E21B 7/26
(52) U.S. Cl. ..... 175/62; 175/171; 405/184
(58) Field of Search ..... 175/62, 19, 171; 405/138, 184, 174

(56) References Cited

U.S. PATENT DOCUMENTS 4,507,019 A * 3/1985 Thompson ..... 405/154
4,898,251 A * 2/1990 Clark et al. ..... 175/27
4,925,344 A * 5/1990 Peres et al. ..... 405/184

* cited by examiner

*Primary Examiner*—David Bagnell
*Assistant Examiner*—Zakiya Walker
(74) *Attorney, Agent, or Firm*—Sand & Sebolt

(57) ABSTRACT

A drive mechanism for a subterranean boring machine includes a drive motor, primary and secondary drive wheels, a drive sprocket and an idler sprocket attached to the primary and secondary drive wheels, respectively, and a chain operatively extending between the drive sprocket and the idler sprocket. The drive mechanism is movably mounted on the sled of a subterranean boring machine that rolls along a track, the drive mechanism being biased against the track by a set of springs to cause the primary and secondary drive wheels to frictionally engage the track. The drive motor selectively and rotatably drives the primary drive wheel which, in turn, drives the secondary drive wheel. The drive mechanism translates the sled along the track under conditions when the sled is not driving a pipe into a subterranean location. The drive mechanism is configured to be largely self-contained to permit existing sleds to be retrofitted with the drive mechanism.

20 Claims, 9 Drawing Sheets

SUBTERRANEAN BORING MACHINE

BACKGROUND OF THE INVENTION

1. Technical Field

The invention relates generally to boring machines and, more particularly, to a drive mechanism for a subterranean boring machine. Specifically, the invention relates to a supplemental drive mechanism that advances and retracts the sled of a subterranean boring machine along a track.

2. Background Information

Subterranean boring machines are used to install subterranean piping without excavating a trough. A subterranean boring machine typically includes a sled that is driven along a track when the machine is configured to install subterranean piping. The sled carries a rotation mechanism that rotates a cutting head in front of the pipe that is being installed. The sled is translated in the forward direction by a translation mechanism that engages the track and drives the sled forward. The pipe includes a rotating auger that draws soil and rock away from the cutting head and discharges the material outside of the subterranean location. The combined effect of the translation mechanism and the rotation mechanism causes the pipe to be driven into its subterranean location. While subterranean boring machines known and understood in the art are effective for their intended purposes, such subterranean boring machines have not, however, been without limitations.

One problem associated with subterranean boring machines is their slow speed of operation. The translation mechanism that drives the sled forward typically includes a pair of dogs that engage drive holes formed in the track and a pair of hydraulic cylinders that expand between the dogs and the sled to drive the sled forward. Inasmuch as the hydraulic cylinders are of limited length, the track is formed with a plurality of regularly spaced drive holes, typically no more that thirty inches apart, into which the dogs must be incrementally engaged. In operation, the dogs engage one set of drive holes and the hydraulic cylinders are expanded driving the sled forward. Once the hydraulic cylinders have expanded to their maximum position, the dogs are released from engagement with the drive holes and the hydraulic cylinders are collapsed until the dogs are aligned with the next consecutive set of drive holes with which the dogs are then engaged. The process must be repeated sequentially with each set of drive holes, resulting in a tedious operation.

Once the sled has been advanced from the initial end to the terminal end of the track and has driven the pipe into the subterranean location by an equal distance, the pipe is released from the sled, and the sled is retracted from the terminal position back to the initial position. Sections of pipe and auger are then added to the ends of the pipe and auger sections that protrude from the subterranean location. The driving process is then repeated. In one example, the track may be thirty-two feet long with the pipe and auger sections being the same length. The incremental driving process is repeated until enough sections of pipe have been driven into the subterranean location to achieve the desired overall length of the pipe.

To move the sled in the reverse direction, the same hydraulic cylinders that drive the sled forward must again be repeatedly expanded and collapsed in conjunction with incremental engagement and disengagement of the dogs in the drive holes. That is, the dogs are retracted from a pair of drive holes and the hydraulic cylinders are expanded to drive the dogs in the rearward direction until aligned with the previous set of drive holes. The dogs are then engaged with the drive holes and the hydraulic cylinders collapsed to retract the sled in the rearward direction. The retraction process is repeated until the sled reaches the initial position. The retraction process consumes as much time as the driving process even though no pipe is being driven and the sled is unloaded.

A need thus exists for a drive mechanism that can quickly retract and advance an unloaded sled of a subterranean boring machine without the need to incrementally engage the dogs of the translation system in sequentially positioned drive holes.

SUMMARY OF THE INVENTION

In view of the foregoing, an objective of the present invention is to provide a drive mechanism for quickly retracting and advancing the sled of a subterranean boring machine along a track.

Another objective of the present invention is to provide a drive mechanism that increases the installation speed of subterranean piping.

Another objective of the present invention is to provide a drive mechanism that can be retrofitted to existing sleds of subterranean boring machines.

Another objective of the present invention is to provide a drive mechanism that serves as an adjunct to the translation system of a subterranean boring machine that is used to drive a pipe into a subterranean location.

Another objective of the present invention is to provide a drive mechanism that selectively advances and retracts a sled of a subterranean boring machine more quickly than the translation mechanism can advance and retract the sled.

Another objective of the present invention is to provide an adjunct drive mechanism that can advance and retract the sled of a subterranean boring machine for purposes other than driving a pipe into a subterranean location.

These and other objectives and advantages are obtained by the improved drive mechanism of the present invention that is adapted to translate a sled of a subterranean boring machine along a track, the general nature of which can be stated as including at least a first drive wheel, the at least first drive wheel adapted to rollably engage the track, and a drive motor operatively connected with the at least first drive wheel.

Other objectives and advantages are obtained from the method of the present invention for excavationless installation a subterranean pipe below a grade, the general nature of which can be stated as including the steps of attaching the pipe to a sled of a subterranean boring machine, thrusting the sled along a track with a translation mechanism, and retracting the sled with a drive mechanism.

Still other objectives and advantages are obtained from the combination of the present invention of a sled of a subterranean boring machine and a drive mechanism, the sled adapted to be translated and retracted along a track, the track being formed with a plurality of drive holes, the general nature of which can be stated as including a sled and a drive mechanism mounted on the sled, the drive mechanism having at least a first drive wheel and a drive motor, the at least first drive wheel operatively connected with the drive motor, the drive mechanism adapted to retract the sled along the track free of interaction with the drive holes.

BRIEF DESCRIPTION OF THE DRAWINGS

The preferred embodiment of the invention, illustrative of the best mode in which applicant has contemplated applying the principles of invention, is set forth in the following description and is shown in the drawings and is particularly and distinctly pointed out and set forth in the appended Claims.

Similar numerals refer to similar parts throughout the specification.

DESCRIPTION OF THE PREFERRED EMBODIMENT

Figure 1:
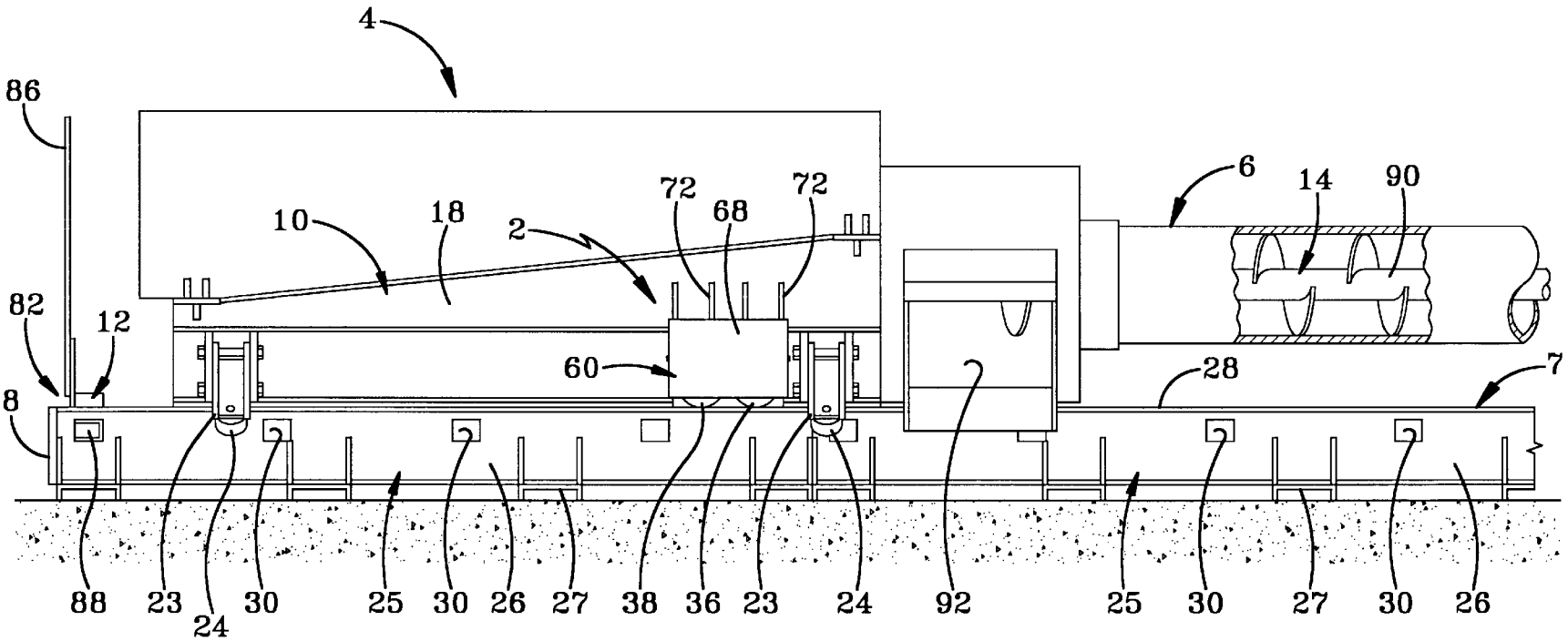
FIG. 1 is a side elevational view of a subterranean boring machine that incorporates the drive mechanism of the present invention.

The drive mechanism of the present invention is indicated generally by the numeral 2 in the accompanying drawings. A pair of drive mechanisms 2 are incorporated into a subterranean boring machine 4 of the type known and understood in the relevant art. Subterranean boring machine 4 drives a pipe 6 into a subterranean location but may be used for other purposes without departing from the spirit of the present invention.

As is known and understood in the relevant art, subterranean boring machine 4 installs pipe 6 into a subterranean location by incrementally advancing individual sections of pipe 6 of a given length until enough sections have been installed that the desired overall length of pipe 6 has been installed in the subterranean location. Subterranean boring machine 4 is rollingly advanced along a track 7 from an initial end 8 to a terminal end 9 (FIG. 3) as subterranean boring machine 4 drives pipe 6 into the subterranean location. After subterranean boring machine 4 reaches terminal end 9 of track 7, it is retracted by drive mechanisms 2 to initial end 8, as will be set forth more fully below. Another section of pipe 6 is then added to the end of pipe 6 that protrudes from the subterranean location and subterranean boring machine 4 is again advanced along track 7 from initial end 8 to terminal end 9 to drive pipe 6 with the new section thereof added into the subterranean location.

Subterranean boring machine 4 includes a sled 10, a translation mechanism 12, and a rotation mechanism 14 mounted to sled 10. Translation mechanism 12 and rotation mechanism 14 together remove dirt and stone from the subterranean location and incrementally drive pipe 6 into the space in the subterranean location created by the removal of the aforementioned dirt and stone. Subterranean boring machine 4 may additionally include a directional apparatus of the type known and understood in the relevant art for adjusting the direction that pipe 6 travels as it is advanced into the subterranean location.

Figure 2:
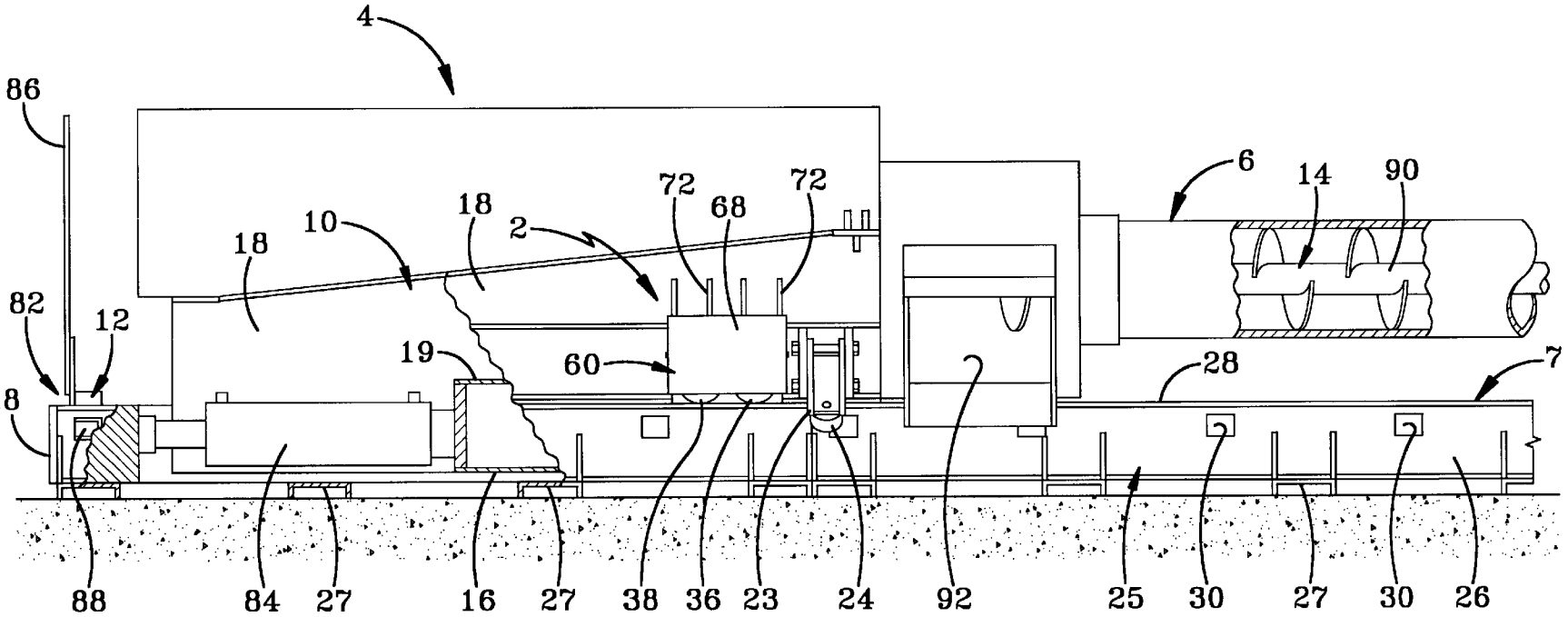
FIG. 2 is a side elevational view, shown partly in section, of a subterranean boring machine that incorporates the drive mechanism of the present invention.
Figure 6:
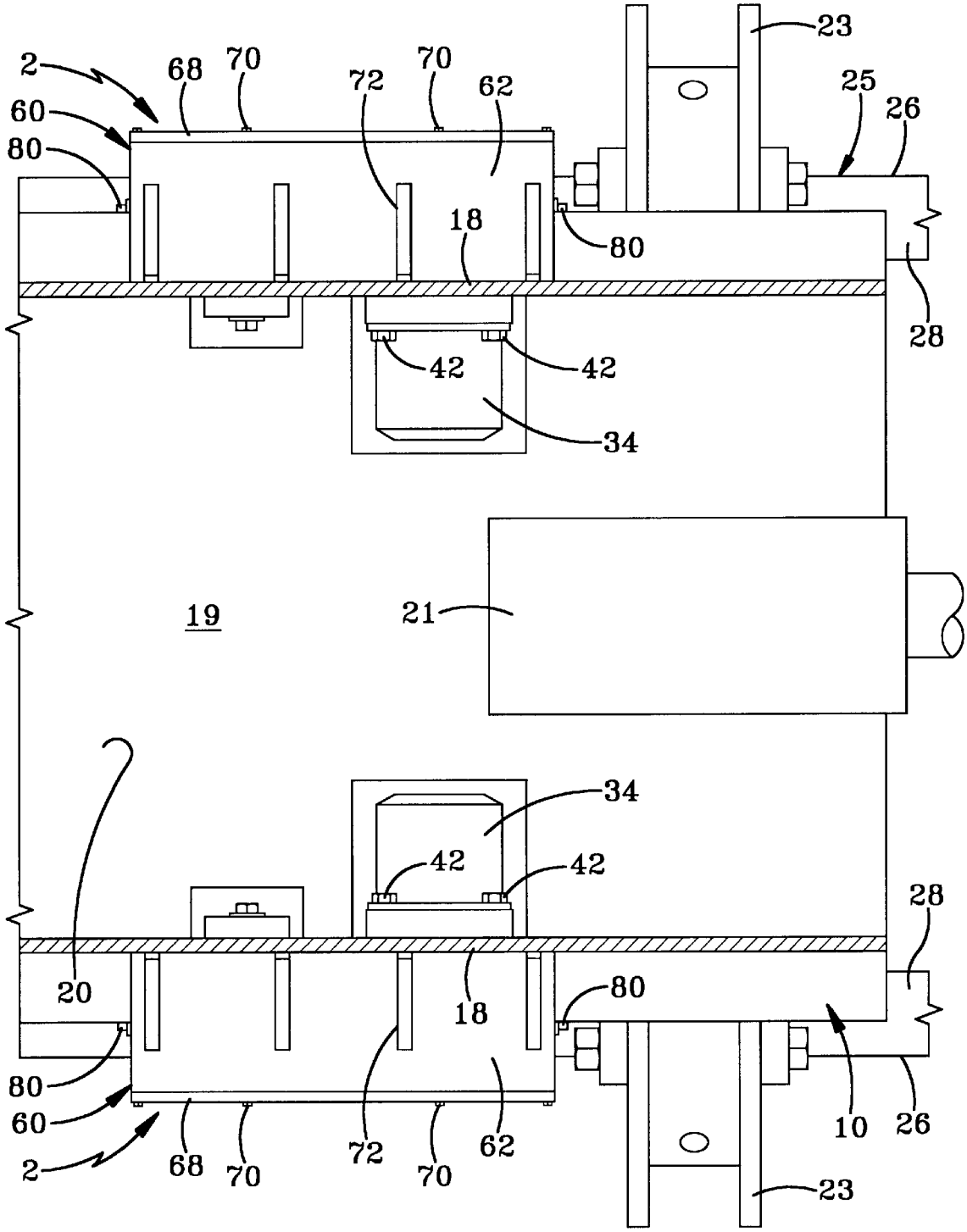
FIG. 6 is a sectional view of the present invention as taken along line 6—6 of FIG. 5.

As seen in FIG. 2, and as is understood in the relevant art, sled 10 is a heavy duty manufactured body that moves rotation mechanism 14 along track 7 and transfers the thrusting force provided by thrusting, or translation mechanism 12 to pipe 6. Sled 10 includes a substantially rectangular and horizontally disposed bottom 16 (FIG. 2) and a pair of vertically disposed side walls 18 attached to opposite sides of bottom 16. An intermediate plate 19 is disposed above and substantially parallel with bottom 16 and extends between side walls 18. Intermediate plate 19 and side walls 18 together define a cavity 20 (FIG. 6) that includes a drill motor 21, with drill motor 21 being a component of rotation mechanism 14, as will be set forth more fully below. Drill motor 21 can be any of a wide variety of motors known and understood in the relevant art for use in subterranean boring machines and is preferably a hydraulic motor driven by high pressure hydraulic fluid, although other types of motors may be used without departing from the spirit of the present invention.

Figure 5:
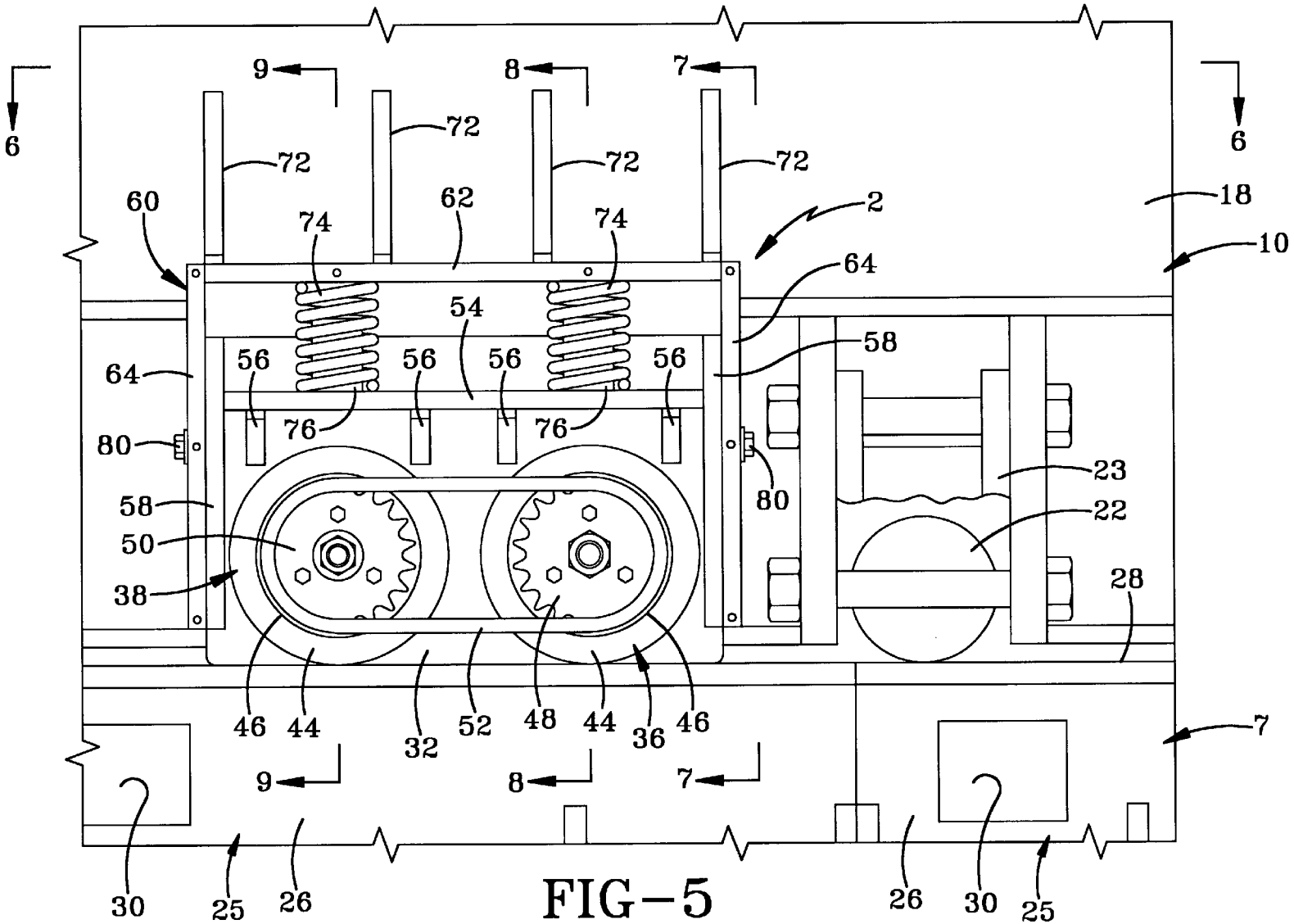
FIG. 5 is a front elevational view shown partially cut away of the drive mechanism of the present invention.

Sled 10 additionally includes four upper rollers 22 (FIG. 5) rotationally mounted on side walls 18 by known structures such as needle bearings, although other rotational mounting mechanisms may be employed without departing from the spirit of the present invention. Four roller arms 23 extend outwardly and downwardly from side walls 18. Each roller arm 23 includes a lower roller 24 rotationally mounted thereon. Upper rollers 22 are each disposed behind roller arms 23 (FIG. 5). One of drive mechanisms 2 is disposed on each side wall 18, as will be set forth more fully below.

Track 7 includes one or more track segments 25 that each include a pair of parallel and spaced apart rails 26. A plurality of parallel and spaced apart bracing members 27 extend perpendicularly between rails 26. Rails 26 each include a substantially horizontal support plate 28 at an upper end thereof and are formed with a plurality of regularly spaced drive holes 30 formed in the vertical web thereof. One or more track segments 25 are assembled sequentially to form track 7 having a length corresponding roughly with the lengths of the sections of pipe 6 that are sequentially added as pipe 6 is driven into the subterranean location.

Upper rollers 22 rollingly engage the upper surfaces of support plates 28 of rails 26, and lower rollers 24 rollingly engage the underside of support plates 28. Side walls 18 are thus interposed between rails 26 and are disposed closely adjacent thereto to permit upper rollers 22 to roll upon support plates 28. Upper rollers 22 support substantially all of the weight of sled 10 and allow sled 10 to roll along track 7. As such, upper rollers 22 are preferably manufactured to be of a size and out of a material suited to withstand the weight of sled 10 such as steel or other appropriate material.

Figure 8:
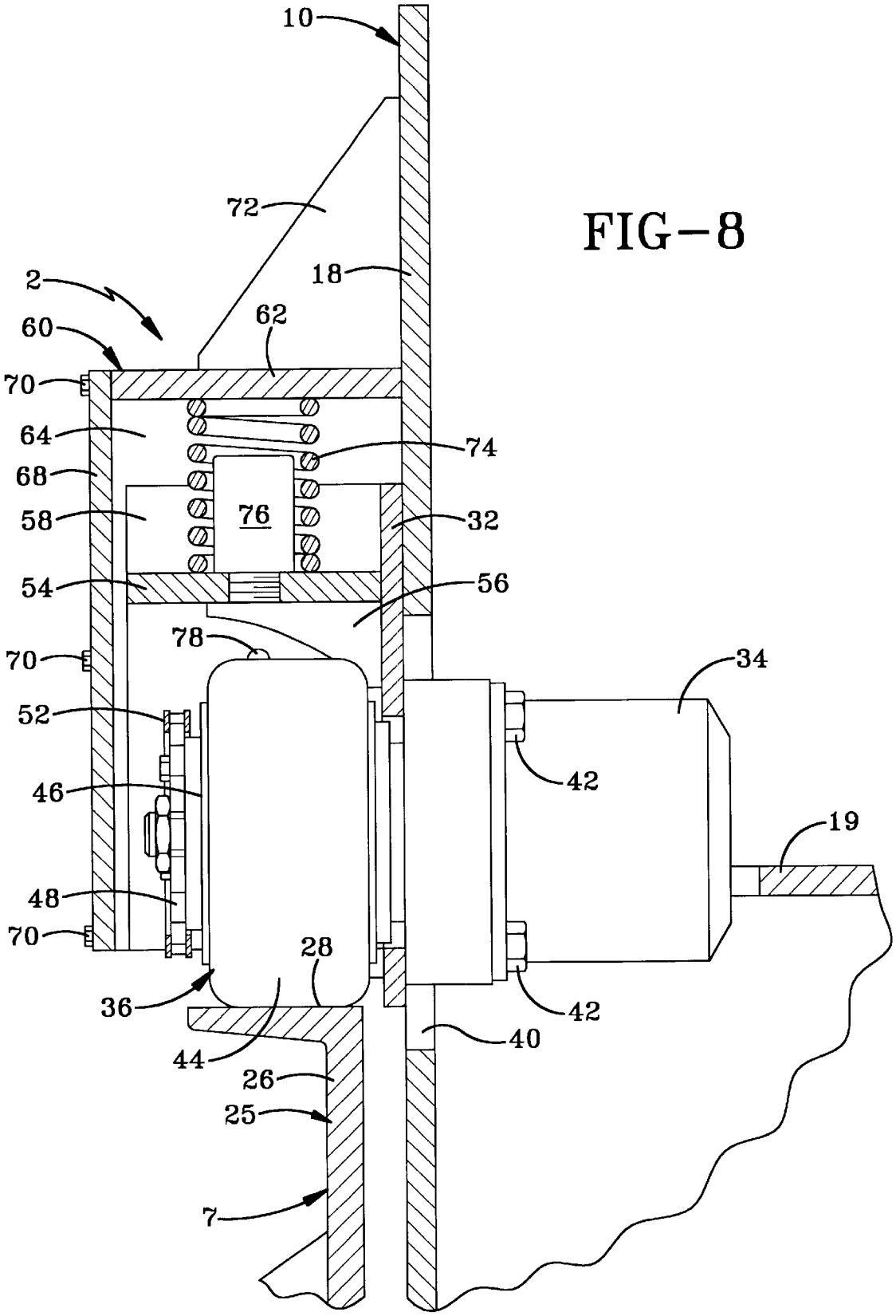
FIG. 8 is a sectional view as taken along line 8—8 of FIG. 5.

Each drive mechanism 2 includes a mounting plate 32, a drive motor 34, a primary drive wheel 36, and a secondary drive wheel 38. Inasmuch as drive mechanisms 2 are mounted on side walls 18 in such a fashion that drive mechanism 2 are configured to be mirror images of one another, only one of drive mechanisms 2 will be discussed hereafter. Drive motor 34 extends through a clearance hole 40 formed in side wall 18 and is attached to mounting plate 32 with a plurality of drive motor bolts 42. Primary drive wheel 36 is operationally mounted on the shaft of drive motor 34. As is best shown in FIG. 8, primary drive wheel 36 is disposed on the side of side wall 18 opposite the attachment of drive motor 34. Primary drive wheel 36 is any of a variety of wheels known in the relevant art, and in the preferred embodiment includes a wheel 44 manufactured of a polymeric material mounted on a hub 46, although other configurations for primary drive wheel 36 can be employed without departing from the spirit of the present invention. Secondary drive wheel 38 is similar to primary drive wheel 36 and is rotatably mounted on mounting plate 32 adjacent primary drive wheel 36.

Drive motor 34 (FIG. 6) is any of a wide variety of motors of the type known and understood in the relevant art and is preferably a hydraulic motor driven by high pressure hydraulic fluid, although other motors may be used without departing from the spirit of the present invention. Primary drive wheel 36 is directly rotationally driven by drive motor 34 when drive motor 34 is in operation. It is understood, however, that drive motor 34 and primary drive wheel 36 may have virtually any spatial relationship with one another so long as drive motor is operationally connected with primary drive wheel 36.

Primary drive wheel 36 includes a drive sprocket 48 coaxially mounted thereon, and secondary drive wheel 38 includes an idler sprocket 50 coaxially mounted thereon. A chain 52 extends between drive sprocket 48 and idler sprocket 50. Primary drive wheel 36 thus drives secondary drive wheel 38 when drive motor 34 is in operation and driving primary drive wheel 36. It is understood that alternate structures such as pulleys and a belt could replace drive sprocket 48, idler sprocket 50, and chain 52 without departing from the spirit of the present invention so long as the alternate structures are capable of transmitting the driving force produced by drive motor 34 between primary drive wheel 36 and secondary drive wheel 38.

Mounting plate 32 additionally includes a horizontally-oriented thrust plate 54 fixedly attached at an upper end thereof such that mounting plate 32 and thrust plate 54 together have a roughly L-shaped configuration. A plurality of bracing ribs 56 extend between mounting plate 32 and thrust plate 54. A pair of side plates 58 are mounted at opposite ends of mounting plate 32 and thrust plate 54 such that mounting plate 32, thrust plate 54, and side plates 58 are disposed roughly within three imaginary orthogonal planes to provide structural support to drive mechanism 2. It is preferred that mounting plate 32, thrust plate 54, bracing ribs 56, and side plates 58 are all formed of a material that is sufficiently strong and tough to withstand the forces that will be experienced in translating sled 10, such as steel, although other appropriate materials may be used without departing from the spirit of the present invention.

Figure 7:
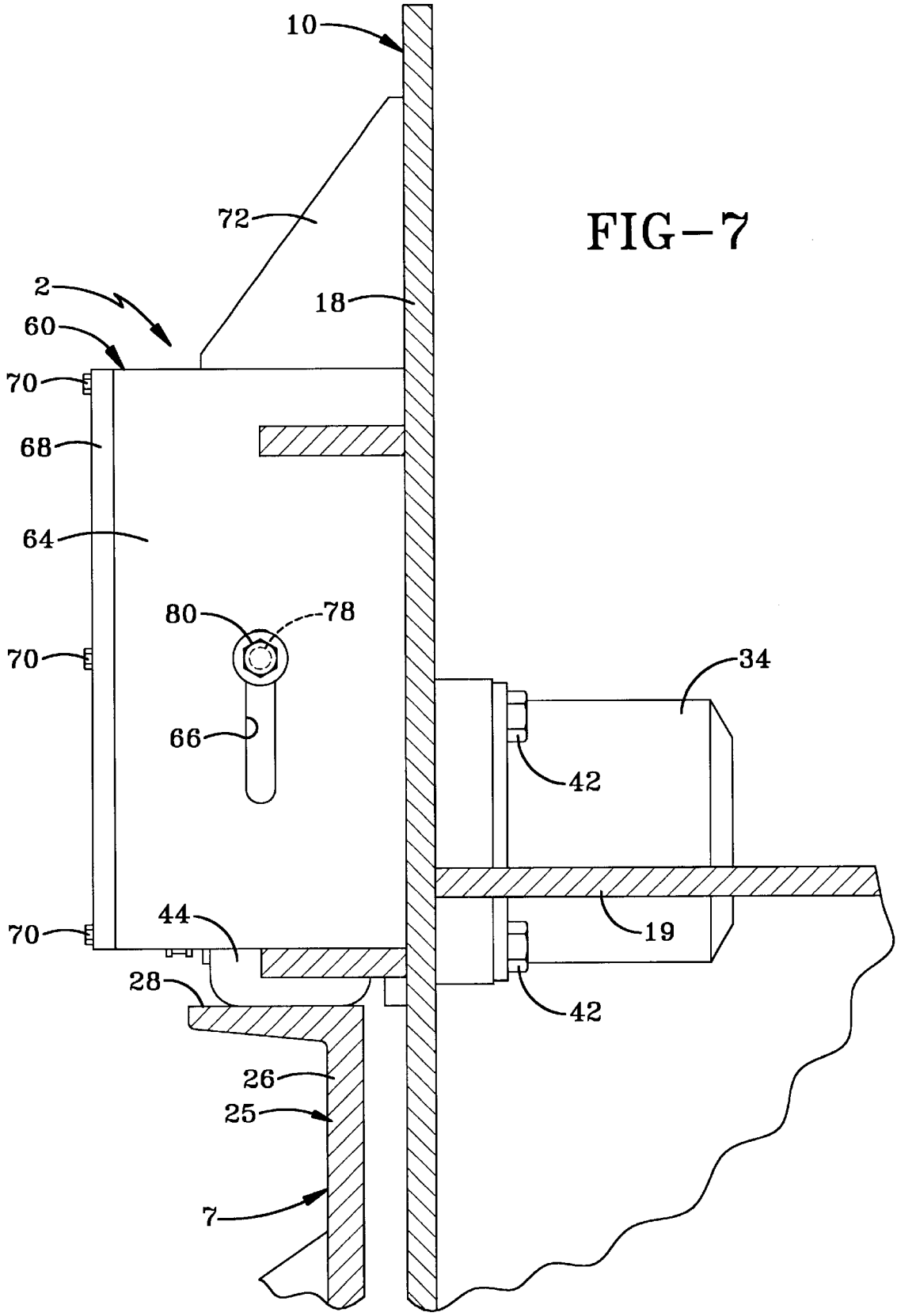
FIG. 7 is a sectional view as taken along line 7—7 of FIG. 5.

Drive mechanism 2 is movably disposed inside a box 60 formed on side wall 18. Box 60 includes a substantially horizontal reaction plate 62 and a pair of parallel and spaced apart retention plates 64 disposed at alternate ends of reaction plate 62 (FIG. 5). As is best shown in FIG. 7, retention plates 64 are each formed with a vertically oriented slot 66 that slidably retains drive mechanism 2 within box 60, as will be set forth more fully below. A cover plate 68 is attached to reaction plate 62 and retention plates 64 with a plurality of cover bolts 70. Box 60 additionally includes a plurality of strengthening ribs 72 extending between the upper surface of reaction plate 62 and side wall 18.

Figure 9:
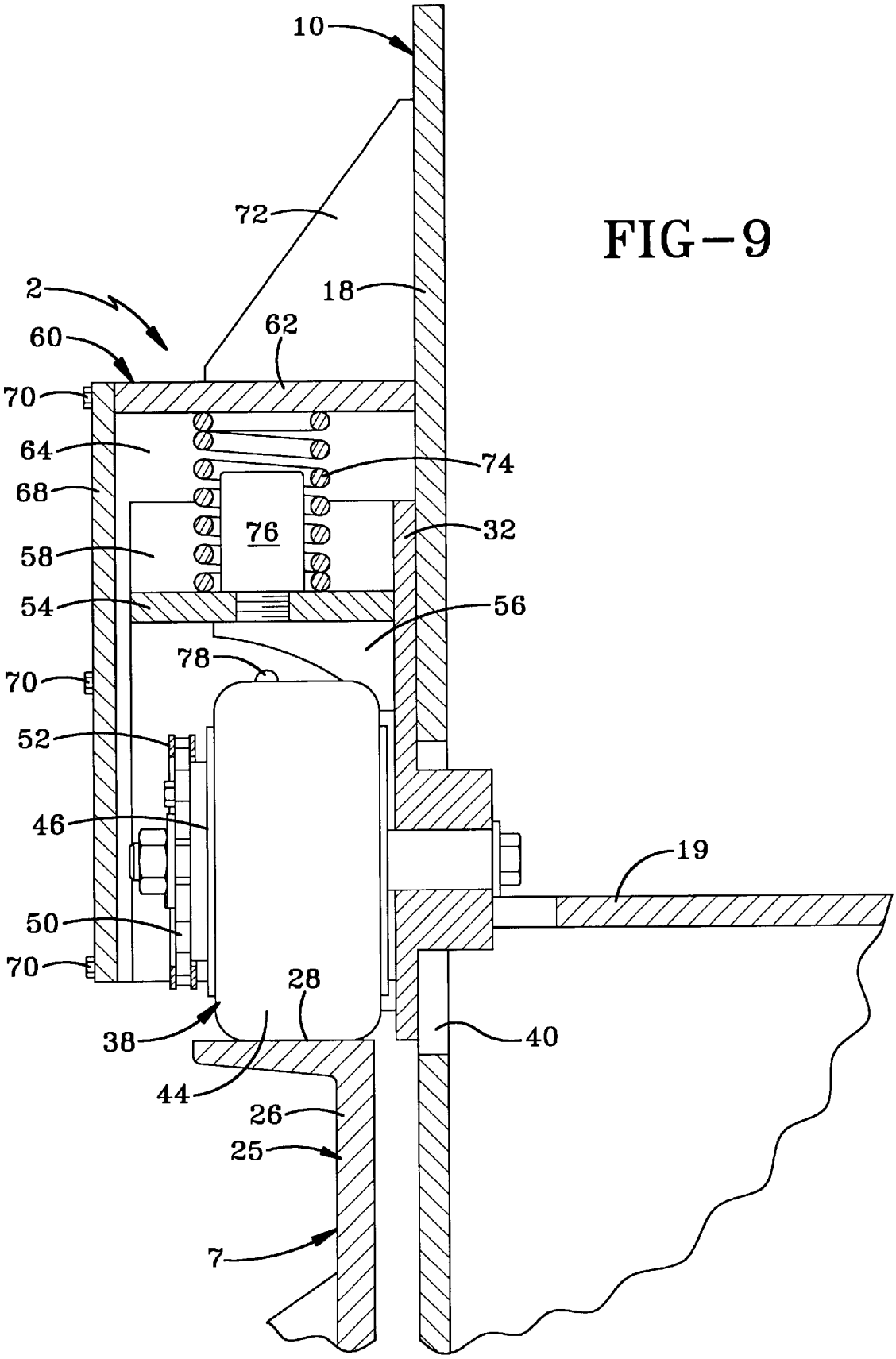
FIG. 9 is a sectional view as taken along line 9—9 of FIG. 5.

A pair of compression coil springs 74 are disposed between reaction plate 62 of box 60 and thrust plate 54 of drive mechanism 2. Each spring 74 is mounted on a cylindrical spring guide 76 disposed on the upper side of thrust plate 54. In accordance with the objectives of the present invention, springs 74 bias thrust plate 54 downwardly toward support plate 28 (FIGS. 8–9) such that primary and secondary drive wheels 36 and 38 frictionally engage support plate 28 of track 7.

Side plates 58 are each formed with a threaded hole 78 that threadably receives a guide bolt 80 (FIG. 7). The shafts of guide bolts 80 extend through slots 66 and move with drive mechanism 2. Slots 66 thus serve to limit the distance that drive mechanism 2 can be biased away from reaction plate 62 and ensure that drive mechanism 2 does not fall out of box 60. The arrangement of slots 66 and guide bolts 80 also prevents springs 74 from becoming disengaged from spring guides 76 when subterranean boring machine 4 is in operation or when sled 10 is lifted from track 7 during initial placement or removal therefrom. It is understood, however, that slots 66, threaded holes 78, and guide bolts 80 could be replaced with other structures for retaining drive mechanism 2 within box 60 without departing from the spirit of the present invention.

In accordance with one of the main features of the present invention, translation mechanism 12 includes a dog engagement mechanism 82 and a pair of linear actuators 84. Linear actuators 84 may take a variety of configurations but in the preferred embodiment and take the form of hydraulic cylinders as shown in FIG. 2. Dog engagement mechanism 82 includes a lever 86 that translates a pair of dogs 88 into and out of operational engagement with pairs of drive holes 30. Each pair of drive holes 30 includes a drive hole 30 disposed on each rail 26, with drive holes 30 of each pair being axially aligned. Hydraulic cylinders 84 are of the type known and understood in the relevant art and operatively extend between dog engagement mechanism 82 and sled 10. When dogs 88 are operatively engaged with a given pair of drive holes 30 of rails 26, hydraulic cylinders 84 can be expanded or collapsed to push or pull, respectively, sled 10 away from or toward dog engagement mechanism 82.

Rotation mechanism 14 includes drill motor 21, an auger 90 disposed within pipe 6, and a discharge chute 92 that is mounted on the front of sled 10 and interposed between sled 10 and pipe 6. A cutting head of the type known and understood in the relevant art is mounted on the leading end of auger 90 ahead of pipe 6 for cutting away soil and rock ahead of pipe 6. Drill motor 21 rotates auger 90 and, in turn, the cutting head. As the cutting head loosens and removes soil and rock ahead of pipe 6, the flights of auger 90 draw the soil and rock rearward away from the cutting head for discharge out of discharge chute 92. Auger 90 is constructed in sections of a given length that are substantially equal to the lengths of the sections of pipe 6, the auger sections being added substantially simultaneously with each successive section of pipe that is incrementally added to pipe 6.

Figure 3:
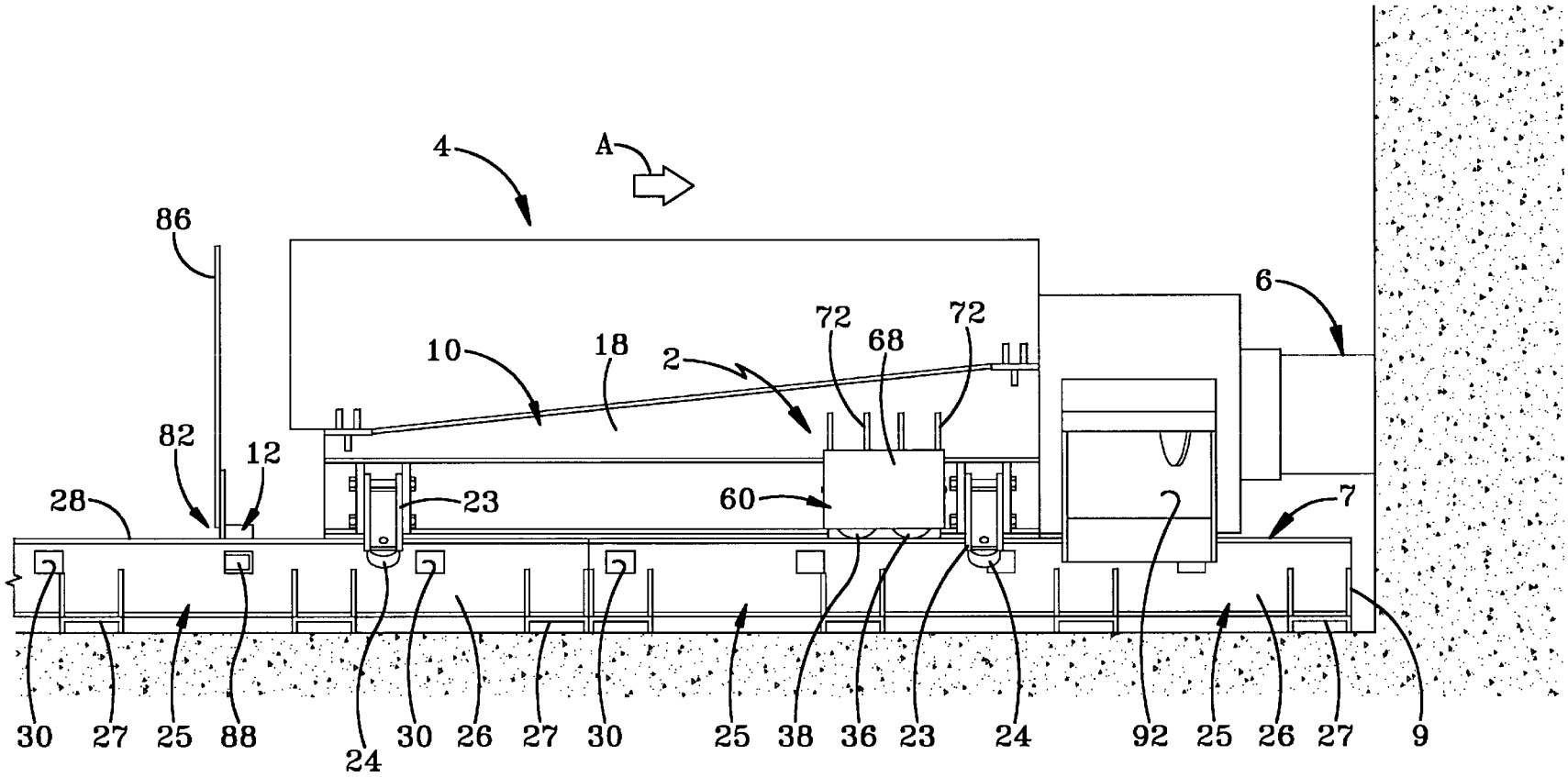
FIG. 3 is a side elevational view of a subterranean boring machine that incorporates the drive mechanism of the present invention with the subterranean boring machine driving a pipe into a subterranean location.

In operation, lever 86 is used to engage dogs 88 in drive hole 30 adjacent initial end 8. A section of auger 90 and a section of pipe 6 are operatively connected to rotation mechanism 14 and drill motor 21 is started. To advance pipe 6 into the subterranean location, hydraulic cylinders 84 are expanded, thus thrusting sled 10 in the direction of arrow A as seen in FIG. 3. Once hydraulic cylinders 84 have reached their maximum extended position, drill motor 21 is halted and lever 86 is operated to disengage dogs 88 from drive holes 30. Hydraulic cylinders 84 are then collapsed, thus pulling dog engagement mechanism 82 in the forward direction toward sled 10. Once dogs 88 are aligned with the next successive set of drive holes 30, lever 86 is operated to engage dogs 88 in the drive holes 30. Drill motor 21 is then restarted and hydraulic cylinders 84 are re-expanded to further thrust sled 10 in the direction of arrow A. The process continues onward until sled 10 reaches terminal end 9.

Figure 4:
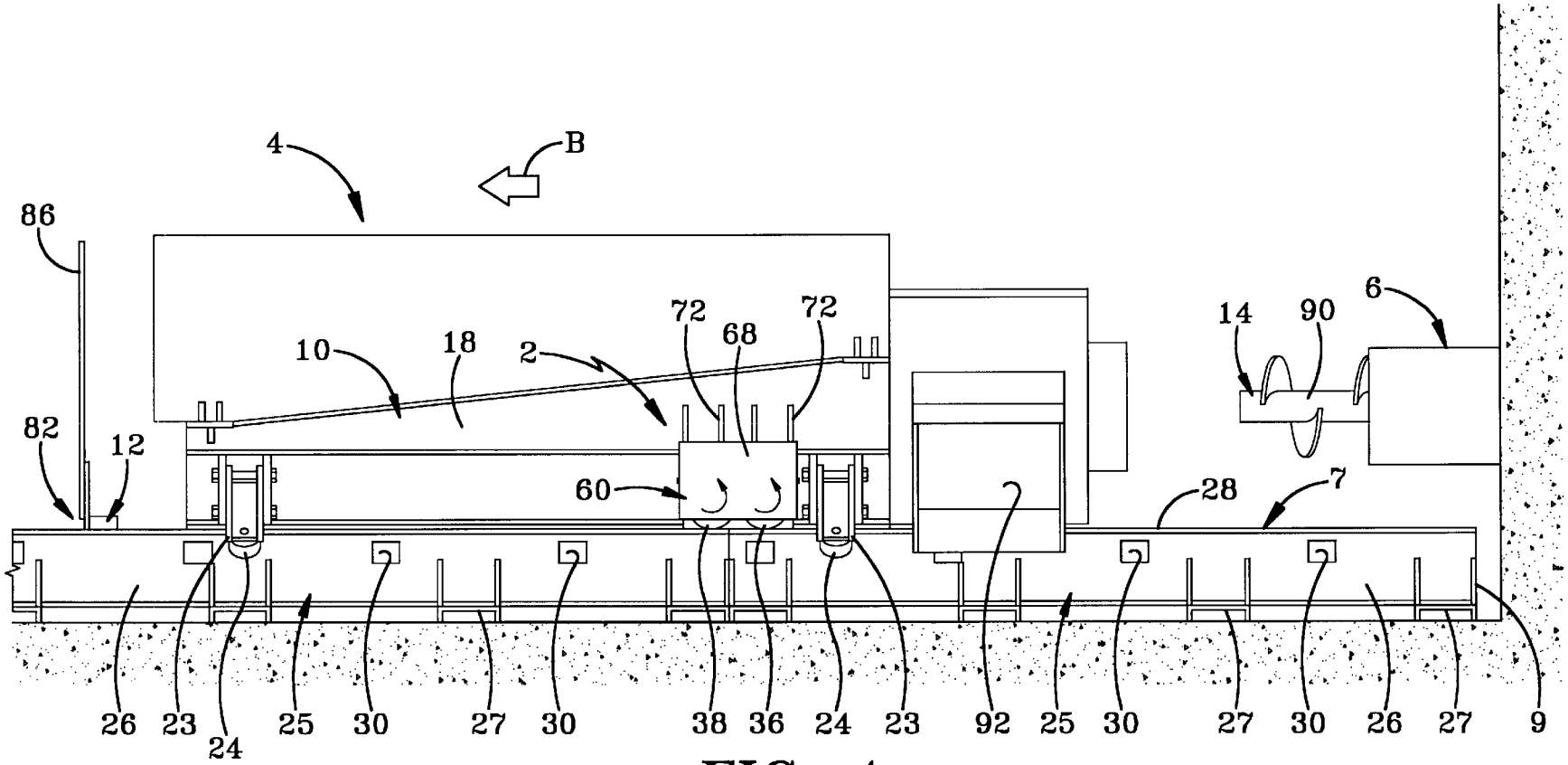
FIG. 4 is a side elevational view of a subterranean boring machine being retracted by the drive mechanism of the present invention.

In accordance with the features of the present invention, when sled 10 can be driven no farther forward, auger 90 and pipe 6 are detached from the front of sled 10, dogs 88 are disengaged from drive holes 30, and drive mechanism 2 retracts sled 10 in the direction of arrow B as shown in FIG. 4. More specifically, drive motor 34 is operated to rotationally drive primary and secondary drive wheels 36 and 38 along support plate 28, thus translating sled 10 with respect to track 7. While upper rollers 22 support nearly all of the weight of sled 10 on track 7, springs 74 bias drive mechanism 2 against support plate 28, thus causing primary and secondary drive wheels 36 and 38 to frictionally engage support plate 28 to impart the necessary translational force to retract sled 10. Drive mechanism 2 can similarly be used to advance sled 10 in the direction of arrow A when pipe 6 is not being driven into the subterranean location. Such advancement is occasionally necessary when a new section of pipe 6 and auger 90 are added and sled 10 must be translated to facilitate reattachment of pipe 6 and auger 90 to rotational mechanism 14.

When drive mechanism 2 is translating sled 10, the rotation of primary and secondary drive wheels 36 and 38 along support plate 28 causes one of side plates 58 to apply a compressive force to the adjacent retention plate 64, which is attached to sled 10. The compressive force applied by drive mechanism 2 to retention plates 64 thus causes sled 10 to be selectively translated along track 7.

In accordance with the objectives of the present invention, the improved drive mechanism 2 thus significantly increases the speed of driving a long subterranean pipe or drilling a long subterranean hole inasmuch as sled 10 can be quickly translated between terminal end 9 and initial end 8 without the need to incrementally engage dogs 88 in drive holes 30 and operate hydraulic cylinders 84 to move sled 10. Drive mechanism 2 thus saves not only time but also effort inasmuch as dogs 88 need not be repeatedly engaged and disengaged with drive holes 30, and hydraulic cylinders 84 need not be repeatedly expanded and collapsed to retract sled 10.

Further in accordance with the objectives of the present invention, drive mechanism 2 can be retrofitted to existing sleds 10 by cutting clearance holes 40 in side walls 18, welding or otherwise attaching box 60 to side walls 18, and installing drive mechanism 2 within box 60. Drive mechanism 2 is designed to be self-contained, and the biasing of drive mechanism 2 against support plates 28 by springs 74 enables primary and secondary drive wheels 36 and 38 to frictionally engage support plate 28 without the need to redesign or reconfigure the rollers or other structures that support the weight of sled 10 inasmuch as drive mechanism 2 does not interfere with or modify the way in which the weight of sled 10 is carried by upper rollers 22. Moreover, if drive motors 34 are hydraulically operated, they can be driven from the same source of pressurized hydraulic fluid that actuates hydraulic cylinders 84, thus further simplifying the process of retrofitting an existing sled with drive mechanisms 2, especially inasmuch as drive mechanisms 2 and hydraulic cylinders 84 are not typically operated simultaneously, but rather are operated as alternative translation mechanisms.

Accordingly, the improved drive mechanism for subterranean boring machines apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the drive mechanism for subterranean boring machines is constructed and used, the characteristics of the construction, and the advantageous new and useful results obtained; the new and useful structures, devices, elements, arrangements, parts, and combinations are set forth in the appended claims.

What is claimed is:

1. A subterranean boring machine apparatus for boring a hole in the earth comprising:

a track;

a boring machine;

a sled for supporting the boring machine and which sled is partially supported on the track;

a drive motor carried by boring machine sled;

at least one drive wheel attached to the drive motor for moving the sled relative to the track;

a thrusting mechanism comprising at least one linear actuator having a first end and a second end; the first end of said at least one linear actuator being in movable contact with the track; and in which the second end of the at least one linear actuator is attached to the sled whereby operation of the at least one linear actuator causes movement of the sled relative to the track, in which the track is formed with at least one hole sized to removably receive the first end of the of the at least one linear actuator, and a dog is attached to the first end of the of the at least one linear actuator, and in which the hole formed in the track is sized to receive the dog, so that expansion of the of the at least one linear actuator moves the sled in a first direction and collapsing the of the at least one linear actuator moves the sled in a second direction; and a spring which is adapted to bias via at least one drive wheel towards the track.

2. The subterranean boring machine as defined in claim 1 in which the first direction is towards the hole to be drilled and the second direction is away from the hole to be drilled.

3. The subterranean boring machine as defined in claim 1 in which there are a plurality of holes formed in the track, and in which each hole is sized to movably receive the dog.

4. The subterranean boring machine as defined in claim 1 in which the track includes a pair of rails; in which there are a plurality of linear actuators, each having a first end which extends adjacent each rail; and in which each rail is formed with a plurality of holes for receiving the first end of each linear actuator.

5. The drive mechanism as defined in claim 1 further comprising a second drive wheel; the second drive wheel being operatively connected to the first drive motor.

6. The subterranean boring machine as defined in claim 5 further comprising a mounting plate, whereby the first drive wheel and the second drive wheel are connected to the mounting plate, and in which the first spring is adapted the bias the mounting the plate towards the track.

7. The subterranean boring machine as defined in claim 6 in which the first and second drive wheels are pivotally mounted on the mounting plate.

8. The subterranean boring machine as defined in claim 7 in which the second drive wheel is operatively connected to the first drive wheel, and whereby the first drive drives the second drive wheel.

9. The subterranean boring machine as defined in claim 8 further comprising a chain operatively extending between the first drive wheel and the second drive wheel.

10. The subterranean boring machine as defined in claim 9 further comprising a drive sprocket mounted to the first drive wheel and an idler sprocket mounted to the second drive wheel whereby the chain is mounted on the drive sprocket and the idler sprocket.

11. A method of operating a subterranean boring machine comprising the steps of:

attaching a pipe to a sled of a subterranean boring machine;

moving the boring machine toward an area to be bored with a thrusting mechanism;

retracting the boring machine away from the area to be bored with a drive mechanism; wherein retracting the boring machine includes retracting the sled and biasing the drive mechanism toward the track.

12. The method as defined in claim 11 including the further step of driving a primary wheel along the track during the retraction step.

13. The method as defined in claim 12 further comprising the step of rotating the primary wheel to translate the sled along the track during the retraction step.

14. The method as defined in claim 11 in which the sled travels along the track during the moving step.

15. The method as defined in claim 14 comprising the further step of movably attaching the sled to the track and applying a force between the track and the sled to translate the sled along the track.

16. The method as defined in claim 14 including further steps of providing a linear actuator to extend between the sled and the track, and operating the linear actuator to move the sled along the track and apply a force to the track.

17. The methods as defined in claim 16 comprising the further steps of providing at least one hole formed in the track; removably inserting an end of the linear actuator into the hole; and expanding the linear actuator against the track surrounding the hole to move the sled along the track.

18. The method as defined in claim 17 including the further steps of providing a track with a plurality of holes, inserting the end of the linear actuator into one hole, expanding the actuator to move the sled to a first position, moving the actuator and moving the actuator and into a subsequent hole, and expanding the linear actuator to translate the sled to a second position.

19. The method as defined in claim 18 further including the step of removing the linear actuator from one hole after the inserting step.

20. The method as defined in claim 19 further including the step of repeating the steps of inserting, expanding, moving and removing steps until the sled is positioned to a preselected distance from the area to be bored.

* * * * *